US010619303B2

(12) United States Patent
Thole et al.

(10) Patent No.: US 10,619,303 B2
(45) Date of Patent: Apr. 14, 2020

(54) METHOD FOR PRODUCTION OF POROUS MOLDINGS

(71) Applicant: Fraunhofer-Gesellschaft zur Förderung der angewandten Forschung e.V., München (DE)

(72) Inventors: Volker Thole, Braunschweig (DE); Julia Belda, Braunschweig (DE); Frauke Bunzel, Braunschweig (DE); Nina Ritter, Braunschweig (DE)

(73) Assignee: Fraunhofer-Gesselschaft zur Förderung der angewandten Forschung e.V., München (DE)

( * ) Notice: Subject to any disclaimer, the term of this patent is extended or adjusted under 35 U.S.C. 154(b) by 18 days.

(21) Appl. No.: 15/984,766

(22) Filed: May 21, 2018

(65) Prior Publication Data

US 2018/0334777 A1 Nov. 22, 2018

(30) Foreign Application Priority Data

May 22, 2017 (DE) ..... 10 2017 111 139

(51) Int. Cl.

| | |
|---|---|
| ***D21J 1/00*** | (2006.01) |
| ***D21F 11/00*** | (2006.01) |
| ***D21H 11/16*** | (2006.01) |
| ***D21B 1/06*** | (2006.01) |
| ***D21H 17/63*** | (2006.01) |
| ***D21H 17/07*** | (2006.01) |
| ***D21H 25/04*** | (2006.01) |
| ***D21J 7/00*** | (2006.01) |
| ***D21B 1/12*** | (2006.01) |

(52) U.S. Cl.

CPC ..... *D21F 11/002* (2013.01); *D21B 1/063* (2013.01); *D21B 1/12* (2013.01); *D21H 11/16* (2013.01); *D21H 17/07* (2013.01); *D21H 17/63* (2013.01); *D21H 25/04* (2013.01); *D21J 1/00* (2013.01); *D21J 7/00* (2013.01)

(58) Field of Classification Search

USPC ..... 162/101

See application file for complete search history.

(56) References Cited

U.S. PATENT DOCUMENTS

| | | | | |
|---|---|---|---|---|
| 2004/0011489 | A1* | 1/2004 | Kimbara | D21J 3/10 162/218 |
| 2009/0255205 | A1* | 10/2009 | Noble | B32B 3/10 52/630 |
| 2016/0052182 | A1* | 2/2016 | Koga | B29C 70/48 |
| 2017/0305232 | A1* | 10/2017 | Vorenkamp | B60H 1/00564 |

FOREIGN PATENT DOCUMENTS

| | | | |
|---|---|---|---|
| DE | 34 20 195 | C2 | 6/1987 |
| DE | 40 08 862 | C1 | 4/1991 |
| DE | 195 28 773 | A1 | 2/1997 |
| EP | 2 615 209 | A1 | 1/2013 |
| GB | 2 303 630 | A | 2/1997 |
| SE | 112 134 | | 10/1944 |
| SE | 116 103 | | 3/1946 |
| WO | 02/055722 | A1 | 1/2002 |

OTHER PUBLICATIONS

"Refiner-Hozstoff," Papier + Technik, Jul. 2009.
"Holzschaum—natuerlich leicht," Fraunhofer WKI, Oct. 2015.
"Bioschaeume als alternative Nutzungsmoeglichkeit fuer nachwachsende Rohstoffe", Technische Universitaet Dresden, Mar. 18, 2016.

* cited by examiner

*Primary Examiner* — Mark Halpern
(74) *Attorney, Agent, or Firm* — W & C IP

(57) ABSTRACT

The invention relates to a method for production of an auto-adhesively bonded, porous, pressure-resistant molding made from comminuted lignocellulosic fibrous materials that are processed at temperatures between 120° C. and 180° C. and a pressure between 2 bar and 8 bar to yield a fiber suspension that is subsequently filled into a mold or applied to a carrier and dried without the addition of a synthetic binder.

24 Claims, No Drawings

METHOD FOR PRODUCTION OF POROUS MOLDINGS

The invention relates to a method for production of an auto-adhesively bonded, porous, pressure-resistant molding made from comminuted lignocellulosic fibrous materials.

Both deciduous and coniferous wood, wood from thinning and other lignocellulosic materials such as hemp, flax, straw, palm, bamboo, bagasse and grass are suitable starting materials. The lignocellulose content can be as high as 100 percent. The moldings can be used especially in the construction industry, for furniture production, in the packaging industry, for acoustic insulation, for thermal insulation and also in moist environments.

Various methods for producing lightweight materials based on renewable raw materials are known. WO 02/055722 A1 describes a method for producing solid products from plant-based starting materials, so-called starch-bonded lightweight wood-based boards. Wood flour or ground straw having a particle diameter of less than 0.5 mm is mixed with starch, especially from corn, but also from grain or rice, appropriate microorganisms, especially yeast fungi or bacteria, and water. The resulting doughlike mass is subjected to a fermentation process under controlled temperature, pressure and moisture conditions and dried at least partially. Then—if necessary—additives can be mixed into the doughlike mass, for example to improve the mechanical properties or the resistance to biological degradation. Finally, the mass in pressed in molds and baked to form a kind of "wooden loaf". The woody fraction of this biogenic lightweight product is a maximum of 78%. The dried material exhibits a bulk density of 230 kg/m$^3$ to 310 kg/m$^3$, the flexural strength lies between 0.9 N/mm$^2$ and 1.5 N/mm$^2$; the thermal conductivity is approximately 0.08 W/mK.

A similar method for producing lightweight products from plant-based starting materials and the addition of natural binders is described in EP 2 615 209 A1. Instead of starch, a part-forming, protein-containing, in particular a gluten-containing, flour is used. To produce these products, cereal flour, wood flour, yeast, swollen and gelatinized starch and water are mixed to form a doughlike mass, then subjected to a fermentation process; finally, this doughlike mass is also placed in molds or cast as a board and baked into a woody "loaf". The woody fraction of these wood-grain lightweight materials is a maximum of 70%, preferably approximately 50%; the bulk density is approximately 340 kg/m$^3$.

A method for producing wood-based insulating boards with a bulk density of 60 kg/m$^3$ to 80 kg/m$^3$ was developed in the 1940s at Kramfors A.B., a Swedish sulfite pulp factory (SE 112 134, SE 116 103, SE 117 003). The method is also designated the Orrmell-Rosenlund or the Kramfors method after the principal developers Aron and Orrmell. Production took place in the 1940s and 1950s at one plant each in Sweden, Finland and the USA. However, these so-called Kramfors boards were unable to compete successfully and production had already ceased by 1951. The starting material for production of these products was chemically treated wood constituents that formed as a by-product during the sulfite process for production of wood pulp. More specifically in this case, the material was largely undigested branch material which was first ground and then mixed with binders and foam-forming substances; however, the exact additives are not documented. It is known, though, that large quantities (30:1 to 4:1) of spent liquor with a high lignosulfonic acid content were added and that this served firstly as a binder and secondly could be beaten to yield a fine-cell foam. This process is highly pH dependent, and so controlling the pH value during the entire production process played a special role; a larger foam volume resulted with increasing pH value. In a modified version of the method, additional small quantities of turpentine were introduced later, since this facilitated better foaming. The mixture, comprising ground branch material, spent liquor, water, turpentine (if necessary) and possibly other additives, was mixed with air or carbon dioxide in a pump. The resultant foamy mass was filled into molding boxes with a screenlike bottom plate and sometimes also perforated side walls. The filled molding boxes proceeded slowly along a transport bridge, during which the liquid drained by gravity sedimentation and a significant decrease in volume occurred. At the end of the transport bridge, the frame was removed, the remaining wet foam cake was either tipped out of the mold or lifted off the sieve plate and dried. After drying, the solid, porous fiber boards underwent fabrication. These porous boards found application virtually exclusively as insulating material in home construction. Instead of the spent sulfite liquor, spent sulfate liquor can also be used (U.S. Pat. No. 2,260,557); this shows that the process can take place both under acidic and basic conditions; in addition, the use of animal glue instead of spent black liquor was mentioned.

In DE 195 28 733 A1 a method for producing a foamed filler material from cellulose through wet foaming is described. Cellulose material such as a fiber slurry, pulp or waste paper is used as starting material. To this is added a mass fraction of 0.1% to 20% of water-soluble adhesive, mass fractions of 0.5% to 20% of a chemical blowing agent and a mass fraction of 10% to 30% of water. The mixture obtained is first preheated to 30° C. to 90° C., then placed in molds and finally heated to 70° C. to 150° C. for foaming and drying. A volume increase of up to 500% of the original volume of the cellulose material is achieved. Starch, sodium carboxymethyl cellulose, ethyl cellulose, methyl cellulose, sodium alginate, casein, gelatin, polyvinyl alcohol and polyvinyl acetate are mentioned as adhesives; azodicarbonamide (ADCA), azobisformamide (ABFA), azobisisobutyronitrile (AIBN), N,N'-dinitrosopentamethylene tetramine (DPT), p-toluenesulfonyl hydrazide (TSH) and p,p'-oxybis(benzenesulfonyl)hydrazide (OBSH) are used as organic blowing agents, while ammonium carbonate and sodium hydrogen carbonate alone or as a mixture are used as inorganic blowing agents. The material is especially suited for use as thermal insulating filler material and as packaging material.

A method for producing viscose foam is described in U.S. Pat. No. 2,077,412. Cellulose xanthogenate is mixed with water and stirred for several hours. Then, ammonium chloride solution and substances that support foaming are added and the mixture is beaten to form a foam. The foamy mass obtained in this way is subsequently solidified through treatment with gaseous sulfurous acid. Fatty acids, especially oleic acid, albumin, soap, saponins, dextrins or rubber materials are named as suitable substances that promote foaming. The material is suited for thermal and acoustic insulation, as packaging material and as filter material.

Methods for producing paper foam are described in DE 40 08 862 C1 and DE 34 20 195 C2. A mixture of paper fibers and plasticizable starch (DE 40 08 862 C1) or of paper fibers, plasticizable starch and polyvinyl alcohol (DE 34 20 195 C2) is compacted and plasticized with the aid of an extruder, and expanded and thus foamed by the temperature and pressure drop on exiting the extruder. This paper foam is used especially as packaging material in the form of flips.

Methods for producing fiber board without the addition of a binder were developed in 1920s in the USA (Masonite method, by W. H. Mason) and also in the 1930s by Dynamit Nobel AG in Troisdorf. The American product went into mass production under the name Masonite in 1929; in 1948 a comparable product made from shavings was placed on the market in Germany under the name TRONAL. In 1948, H. Sächtling describes in "*Einige neue Verfahren zur Erzeugung von Bauplatten aus geringwertigen Holzrohstoffen*" (Some new methods for producing structural panels from low-grade wood raw materials) in Holzforschung, Issue 1, p. 21, that the scientific basis of this method can be traced to W. Klauditz. He was able to show that the strength of fiber moldings depended not so much on the fiber length, but instead on the contact surfaces of the criss-crossing fibers. The raw material used for ground wood production and thus for the TRONAL board was coniferous wood; deciduous wood was not used, since no fibers, but rather only a flourlike substance without any adhesive or binding action was obtained. Stock preparation occurred in two steps: first, the material was initially ground to an SR value of 20 to 22 in cross-beater mills having a basalt lining or in defibrators; these fibers were then finish-ground in Hollander beaters having a basalt lining to achieve the desired SR value—typically between 55 and 80. The prepared fibers were suspended in water and filled into casting machines. The excess water was pressed out in molding boxes with a screen bottom, and a fiber cake having a solids fraction of approximately 20% was obtained. This was dried in multi-level hot air driers at max. 120° C. or compacted to high bulk densities and cured by hot pressing. This method produced fiber boards in a bulk density range of 150 kg/m$^3$ to 1400 kg/m$^3$. Regulating factors included digestion of the fibrous material and also the compacting pressure. The lightweight TRONAL boards (Type L) were not pressed; in this way and depending on the degree of grinding fiber boards having bulk densities in the range of 150 kg/m$^3$ to 400 kg/m$^3$ could be achieved. The flexural strengths were between 3 N/mm$^2$ and 6 N/mmm$^2$.

Lightweight materials are found in an extremely wide variety of fields, for example, in construction, in the automotive industry and in packaging. In addition to the weight savings, the thermal and acoustic insulating properties that result from the high porosity of the materials are often of prime importance. Most of the lightweight materials produced are foams based on petrochemical base materials. A much smaller proportion is produced from renewable raw materials; among these are highly porous mats, nonwovens and interlaid scrim of natural fibers. Products of this kind are found as thermal insulation in construction as well as for sound absorption in vehicles. Nonwovens and interlaid scrim of natural fibers have the disadvantage of exhibiting minimal pressure resistance. In addition, in contrast to synthetic foams, closed-cell structures cannot be created.

The known foam materials using wood or paper fibers always required, during production, binders for stabilization and raw materials that could be extracted in an acidic or basic environment. Furthermore—especially in the case of paper—the fibrous materials need to undergo time-consuming grinding for several hours in order to obtain a consistency that was suitable for processing. As a result, the methods become highly dependent on the condition of the raw material and expensive because of the binders and long process time. Moreover, blowing agents that make the product considerably more expensive are required and, like the binders, always represent a possible source of undesirable or even toxic emissions. The bulk density could also not be adjusted as desired with all methods, which had an adverse effect especially on possible applications.

It is the purpose of the present invention to provide a method that does not exhibit these disadvantages and at the same time allows production of an inexpensive, porous, pressure-resistant material from renewable raw materials without chemical treatment and subsequent material separation or a chemically induced depolymerization of the raw materials. The moldings should completely or at least largely comprise plant-based materials. In addition, the method should permit controlled adjustment of the bulk density via the production process.

Further, the materials should be easily recyclable due to their constituent components and during incineration have an emission potential which corresponds to that of a comparable amount of wood.

It was found surprisingly that to stabilize a molding of lignocellulosic fibers no chemically induced digestion and no additional synthetic binders are required, since during mechanical disintegration at a temperature between 120 and 180° C. binders are released from the parts of the plants. As a result, a pressure-resistant, porous molding, whose mechanical properties can be adjusted over a wide range depending on the fibrous materials used, the fiber length, the degree of foaming of the fiber suspension and the manner of drying, can be produced without synthetic binders.

With regard to the raw materials, all types of lignocelluloses are possible. In the method according to the invention, all wood types, including bark or root material, sawmill by-products and wood from thinning as well as scrap wood, various annual plants without chemical pretreatment and even modified lignocellulosic raw materials are suitable. Surprisingly, it was found that deciduous woods in particular represent especially well-suited raw materials.

The method according to the invention for producing a porous molding provides that precomminuted, lignocellulosic fibrous materials are processed at temperatures between 120° C. and 180° C. and at a pressure of 2 to 8 bar, if necessary together with water, to yield a fiber suspension, in particular are disintegrated, and that said suspension is subsequently filled into a mold or applied to a carrier and dried without the addition of a synthetic binder. This results in a porous structure, that is, an open-cell and permeable structure, which allows lightweight construction having high damping and insulating properties. In addition, it is possible with the method to obtain a simultaneously pressure-resistant molding that exhibits compressive strengths between 20 kPa and 600 kPa to DIN EN 826 at 10% compression. It is consequently possible to produce lightweight, stable, permeable and arbitrarily shaped moldings that can be used in a variety of ways.

During the grinding process, the temperature can be increased stepwise, that is, in intervals; the temperature increase can also take place in equally spaced steps.

A further embodiment of the invention provides that up to 70% of the entire disintegration takes place at the target temperature, so that the disintegration is carried out at the intended maximum temperature in order to release the binders contained in the lignocellulosic fibrous materials.

During production of the comminuted fibrous materials, further comminution of the fibers to a desired fiber length between 200 to 800 μm can occur in a thermomechanical process (TMP), preferably in an atmospheric refiner without positive pressure and at room temperature. Adjustment of the fiber length obtained is achieved through the use of different grinding disk geometries, adjustment of the refiner plate clearance and also adjustment of the number of grinding cycles, which may be between 1 and 10. To adjust the density of the finished molding, preferably different suspensions are mixed, or a fiber suspension is prepared from batches of fibrous materials having different fiber lengths and then cast into a mold or placed on a carrier.

The invention provides that a high-viscosity suspension having a solids-water ratio of 1:2 to 1:20, preferably of 1:5 to 1:10, is produced from the aqueous fiber suspension prior to introduction into the mold or placement on a carrier. Dewatering can take place through use of a decanter or other mechanical dewatering means in order to reduce the amount of thermal energy needed during drying.

A screen belt, a nonwoven belt or a conveyor belt can be used as carrier in order to permit continuous production. The belts can be restricted laterally and be water-permeable in order to allow preliminary mechanical dewatering. A three-dimensional, single-piece or multi-piece mold with closed or perforated walls can be used as the mold to allow more complex shapes. The mold is preferably provided with a nonstick coating, for example made of PTFE, or is made from a nonstick material to facilitate demolding.

The high-viscosity suspension can be introduced into the mold under pressure to achieve uniform filling of the mold and a variation in the density of the filling and the finished product.

Prior to the thermal drying, the high-viscosity suspension can undergo preliminary dewatering by means of reduced pressure or via mechanical pressure in order to reduce the amount of thermal energy required. The thermal drying can be accomplished through use of convective and/or conductive heat flow and/or thermal radiation and/or electromagnetic radiation, with the drying preferably being performed in a dryer at temperatures of initially between 110° C. and 140° C. The suspension introduced into the mold or placed on the carrier is dried preferably between 0.5 and 2 hours at the high temperatures in order to activate the auto-adhesive bonding, then the drying temperature is reduced to below 80°, preferably to 70° C., in order to remove the remaining moisture. The remaining drying time depends especially on the manner of drying and can be between 5 and 12 hours in a drying cabinet and between 10 and 30 min when drying by means of electromagnetic radiation.

Additives in the form of blowing agents, especially gas-producing agents ($CO_2$-producing agents), $N_2O$, propane, n-butane or pentane, or fully decomposing blowing agents, especially hydrogen peroxide, can be added to the high-viscosity suspension prior to its introduction into the mold or placement on a carrier. Additionally or alternatively, gases for foaming can be introduced into the high-viscosity suspension by mechanical, pneumatic and/or thermal processes prior to its introduction into the mold or placement on the carrier.

A further embodiment of the invention provides that after or during production of the high-viscosity suspension process additives, product-improving additives or additives for adjusting desired product properties are added, for example, hydrogen peroxide alone for adjusting the porosity. Furthermore, constituent ingredients of wood such as lignin, hemicellulose and cellulose can be chemically changed in such a way through use of hydrogen peroxide and high temperatures that these components react with one another and create a bond between the fibers. This bond is water-resistant as a result of which the foam does not decompose in water, allowing production of a stable, foamed suspension that also remains stable in the mold and on the carrier during the drying process, so that a pressure-resistant, porous molding can be obtained after drying.

It is also possible and lies within the scope of the invention that additives in the form of hydrophobizing agents, especially synthetic or natural oils, paraffins, waxes or organosilicon compounds and/or additives in the form of flame retardants and/or corona-shielding agents and/or antimycotics, especially a mixture of soda and whey, are added to the high-viscosity suspension. A further embodiment of the invention provides that organic blowing agents in the form of azobisisobutyronitrile, azodicarbonamide, especially activated azodicarbonamide, dinitropentamethylene tetramine, hydrazodicarbonamide, oxybissulfohydrazide, oxybisbenzenesulfohydrazide, 5-phenyltetrazole, para-toluenesulfonylsemicarbazide, toluene/benzenesulfohydrazide and their salts, especially alkali metal and alkaline earth metal salts, are added to the high-viscosity suspension.

As inorganic blowing agents, ammonium carbonate, sodium hydrogen carbonate, preferably in a mixture with potassium hydrogen carbonate and an acid carrier, especially disodium dihydrogen diphosphate, calcium dihydrogen phosphate or calcium citrate, and also aluminum powder can be added to the high-viscosity suspension either in an acidic or a basic medium.

The organic or inorganic blowing agents can be used either alone or as mixtures of at least two thereof in proportions of 0.25% mass fractions up to 20% mass fraction based on the dry mass.

To improve the properties of the finished product, spent sulfite or sulfate pulp liquor and also turpentine oil, gelling agents, alginates, flour or starch from grain, potatoes, corn, peas or rice and/or crosslinking agents, especially based on methyl cellulose or gluten, can be added to the high-viscosity suspension.

A variant of the invention provides that synthetic additives, especially isocyanates and polymers, especially polyvinyl alcohol, polyethylene glycol, polyvinyl acetate and alums can be added to regulate the pH value, preferably in small quantities, in order to enlarge the property spectrum of the moldings.

The additives can be used either alone or as mixtures of at least two thereof, especially in quantities of 0.2 mass % to 35 mass %, preferably in quantities of 3 mass % to 15 mass % based on the dry mass.

Fiber digestion represents an important component of producing lignocellulose foam. The actual process of foaming occurs either through addition of a blowing agent or strong stirring until a foamy consistency is achieved. The foam subsequently hardens upon thermal removal of water.

The method according to the present invention is further characterized in that native, untreated raw materials are used that in most cases are subjected to at least two disintegrating grinding processes in succession in order to create a high-viscosity fiber mass. To start with, the raw materials undergo preliminary comminution in an initial process step to obtain TMP, CTMP, mechanical wood pulp or pressure ground wood pulp. Then the fiber mass, preferably still wet, is subjected to an intense grinding process. This high-viscosity grinding releases polyoses and accessory constituents without chemically degrading the cellulose. The intense grinding also causes shortening and fibrillation of the cellulose fibers. The fiber lengths obtained lie—depending on the degree of grinding and the kind of lignocellulosic raw material—between 200 μm and 2500 μm. The crushing and rubbing of the fibers partially destroys the primary cell wall, followed by fibrillation of the secondary cell wall, and a mucilage is formed. This mucilage comprises fibrils, hanging on the fibers like fringes, that have been released from the secondary wall. At the same time, the fibrillation results in a significant increase in particle surface area. According to the invention, this mucilage and the increased particle surface area, along with the released constituents, lead to good gas retention capability during production; furthermore, they contribute significantly to the cohesion of the final solid foam. Cohesion is thus achieved on the basis of the wood's own binding forces activated during the production process. To attain the required high-viscosity consistency, at least one kind of the above-mentioned lignocelluloses, preferably wood, undergoes preliminary comminution by means of a refiner, a toothed colloid mill, a corundum stone mill or the like to produce fibrous material and is subsequently subjected to high-viscosity grinding in identical or similar equipment, during which the plant raw materials of the lignocelluloses are preferably crushed and torn apart and not cut, thereby achieving the high-viscosity consistency, here the weight ratio of lignocelluloses to water during grinding, e.g. in the grinding pan, is 1:2 to 1:20, preferably 1:5 to 1:12, the desired high-viscosity consistency, supported by release of the plant's constituents and the polyoses, can be achieved especially easily if a controlled temperature increase takes place in intervals, the pH value is between 4 and 10, preferably between 5 and 8, and the grinding process occurs at a normal or a positive pressure of up to 8 bar. At the same time, pulping processes can be performed.

The ground plant material is separated from the excess water by a screen to obtain the mass called the high-viscosity suspension. The plant mass with the high-viscosity consistency can be formed into the desired porous moldings in accordance with the following exemplary embodiments. The prepared high-viscosity suspension is then poured into molds that preferably are made from perforated sheet metal or screens on the bottom and the sides, or incorporate perforated sheet metal and/or screens, and subsequently dried via thermal water removal, for example, through microwave drying, in steam autoclaves or in a drying cabinet.

The use of a foamed suspension of lignocellulosic fibers is essential for successful creation of the new product. These fibers are required for a certain gas retention capability and for the good cohesion of the finished product; a synthetic binder is not required. The higher the degree of disintegration of the fibrous materials, the better is the cohesion. Through controlled variation of the degree of mechanical disintegration of the lignocelluloses, the water content and the manner of generating the porous structure, e.g. through chemical or physical foaming or a combination of both methods, if necessary with or without additives, the density and the properties of the lignocellulose foam can be controlled as desired. The combination with hydrogen peroxide as blowing agent is especially well-suited.

The product is a solid, dimensionally stable foam that is odorless and can be processed like other wood-based materials. This new lightweight material is suitable for use as lightweight structural panels, for insulating purposes, as packaging material, acoustic elements, toys as well as for a wide variety of moldings having a cellular structure. It is suitable as the lightweight middle layer in sandwich constructions, since it can be veneered on both sides. The porous structure ensures a significant reduction in thermal conductivity and transmission of sound. During the production process, additives can be incorporated easily, for example, hydrophobizing agents such as synthetic or natural oils, paraffins, waxes, organosilicon compounds, flame retardants/corona-shielding agents and/or antimycotics, e.g. synthetic or natural agents such as a mixture of soda and whey. Owing to the flowable consistency, any 3-D (three-dimensional) structure can be produced. Without the controlled addition of antimycotics, the foams decompose within an acceptable time on longer storage in a moist environment, e.g. in the ground.

To improve the durability of the finished molding in outdoor use, the fibrous materials can be acetylated prior to comminution, so that the water absorption capability of the fibrous materials is reduced. Because of their porosity, the moldings themselves still remain capable of absorbing water.

Adjustment to the desired compressive strength is possible through mixing of different fiber lengths. The spectrum of fiber lengths ranges from 200 μm to 2500 μm, with an increase in compressive strength possible through addition of longer fibers to the fiber suspension at a proportion of between 5%-50% of fibers having a fiber length between 1000 μm and 2500 μm. In addition, the type of wood and/or addition of natural binders such as starch, lignin sulfonate, proteins, for example, at a proportion of 2 to 20%, can increase the compressive strength. The same holds for the addition, in particular, of 2%-20% of adhesives as an aqueous dispersion based on PMDI, polyurethane and/or polyvinyl acetate.

Because of the water-resistant bonding, the resultant molding is suitable for use in moist environments. It exhibits a slight swelling in thickness and becomes stable again after drying. The densities and strengths of the end products can be adjusted via the fiber lengths used, especially through mixing of groups having different fiber lengths, and the wood fibers used. Alignment of the fibers is not necessary for this; actually, the fibers are not aligned in the molding.

Adjustment of the molding's density can be achieved by changing the amount of long fibers, for instance. Thus, addition of longer fibers (1000 μm-2500 μm) lowers the density of the molding; similarly, use of a larger amount of emulsifiers such as surfactants or proteins allows incorporation of a greater amount of gas, which in turn lowers the density. Increasing the amount of hydrogen peroxide used lowers the density, since the amount of gas increases.

The water absorption capability of the molding depends on the type of wood used, with coniferous woods exhibiting a lower water absorption capability than deciduous woods. The greater the porosity achieved, i.e. the ratio of pore volume to the overall volume of the molding, the greater is the amount of water that can be absorbed by the molding, whereby the water is held in the pores in the molding. Wood fibers, which inherently tend to absorb water, can be impregnated with hydrophobic additives such as waxes or silanes. A fiber pretreatment such as acetylation also reduces the water absorption capability.

The ability of the molding to absorb sound is adjusted via the density and the porosity; the greater the porosity, and thus the lower the density, the greater is the sound absorption by the individual molding.

The fiber properties can be influenced in the refiner process, for example, through the above-described hydrophobization, through acetylation and/or the addition of waxes and/or melamine in an amount of 1%-15%. If hydrophobization of the fibers is desired, it can be improved by using an elevated temperature of 160° C.-180° C. By incorporating acrylates, urea, melamine, glyoxal and/or gloxylic acid (2%-20%) in the refiner process, the bonding of the fibers to one another can be strengthened.

Improved elasticity of the molding can be achieved through the addition of rubber (10%-60%) or through the addition of polyurethane (10%-60%).

The invention is discussed further using the following examples.

EXAMPLE 1

A suspension of beechwood fibers (TMP) or pinewood fibers and water having a solids content of 7% undergoes further defibration in an atmospheric refiner at room temperature. Next, excess water is removed from the high-viscosity wood fiber suspension by a screen and a solids content of 10% to 15% results. 1000 g of high-viscosity suspension are stirred proportionately with 5% to 35% of hydrogen peroxide (35% solution in water) for up to four minutes in a high-intensity mixer at room temperature. The homogeneous, flowable mass is filled into a mold perforated on all sides and dried at 130° C. for 6 to 20 hours in an oven. The resultant lignocellulose foams exhibit bulk densities of between 50 kg/m$^3$ and 250 kg/m$^3$ and bulk density-dependent compressive strengths of 20 kPa to 350 kPa at 10% compression.

EXAMPLE 2

1000 g of high-viscosity suspension (beechwood fibers or pinewood fibers) having a solids content of 10% to 15% are mixed proportionately with 7% to 20% of protein and then stirred to yield a homogeneous mass (cf. Example 1). Then, proportionately 5% to 35% of hydrogen peroxide (35% solution in water) are added smoothly little by little while stirring. The homogeneous, foamy mass is filled into a mold perforated on all sides and dried at 130° C. for 6 to 20 hours in an oven. The resultant lignocellulose foams exhibit bulk densities of between 50 kg/m$^3$ and 250 kg/m$^3$ and bulk density-dependent compressive strengths of 20 kPa to 600 kPa at 10% compression.

EXAMPLE 3

1000 g of high-viscosity suspension (beechwood fibers or pinewood fibers) having a solids content of 10% to 15% are mixed proportionately with 0.5% to 5% of lignin sulfonate solution (55% solution in water) and then stirred to yield a homogeneous mass (df. Example 1). Then, proportionately 5% to 35% of hydrogen peroxide (35% solution in water) are added smoothly little by little while stirring. The homogeneous, foamy mass is filled into a mold perforated on all sides and dried at 130° C. for 6 to 20 hours in an oven. The resultant lignocellulose foams exhibit bulk densities of between 50 kg/m$^3$ and 250 kg/m$^3$ and bulk density-dependent compressive strengths of 20 kPa to 240 kPa at 10% compression.

EXAMPLE 4

1000 g of high-viscosity suspension (beechwood fibers or pinewood fibers) having a solids content of 10% to 15% are mixed proportionately with 5% to 10% of starch and 7% to 20% of protein and then stirred to yield a homogeneous mass (cf. Example 1). Then, proportionately 5% to 35% of hydrogen peroxide (35% solution in water) are added smoothly little by little while stirring. The homogeneous, foamy mass is filled into a mold perforated on all sides and dried at 130° C. for 6 to 20 hours in an oven. The resultant lignocellulose foams exhibit bulk densities of between 50 kg/m$^3$ and 250 kg/m$^3$ and bulk density-dependent compressive strengths of 20 kPa to 600 kPa at 10% compression.

EXAMPLE 5

1000 g of high-viscosity suspension (beechwood fibers or pinewood fibers) having a solids content of 10% to 15% are mixed proportionately with 10% to 25% of polyurethane dispersion and proportionately with 7% to 20% of protein and then stirred to yield a homogeneous mass (cf. Example 1). Then, proportionately 5% to 35% of hydrogen peroxide (35% solution in water) are added smoothly little by little while stirring. The homogeneous, foamy mass is filled into a mold perforated on all sides and dried at 130° C. for 6 to 20 hours in an oven. The resultant lignocellulose foams exhibit bulk densities of between 50 kg/m$^3$ and 170 kg/m$^3$ and bulk density-dependent compressive strengths of 20 kPa to 350 kPa at 10% compression.

The invention claimed is:

1. A method for production of an auto-adhesively bonded, porous, pressure-resistant molding, comprising:

forming an aqueous fiber suspension from comminuted lignocellulosic fibrous materials that are processed at temperatures ranging from 120° C. to 180° C. and a pressure ranging from 2 bar to 8 bar;

introducing gases for foaming into the suspension by mechanical, pneumatic and/or thermal processes, and/or adding blowing agents to the fiber suspension prior to filling the fiber suspension into the mold or applying the fiber suspension to the carrier;

filling the fiber suspension into a mold or applying the fiber suspension to a carrier; and drying the fiber suspension, wherein the steps of forming, filling or applying, and drying are performed without the addition of a synthetic binder.

2. The method according to claim 1, wherein the forming step includes an additional step of comminuting the fibrous materials in an unpressurized refiner and at room temperature to produce a fiber length ranging from 200 to 800 μm.

3. The method of claim 1, further comprising dewatering of the aqueous fiber suspension by decanting to yield a high-viscosity suspension having a solids-water ratio of 1:3 to 1:10 prior to filling into the mold or applying to the carrier.

4. The method of claim 1, wherein the carrier is selected from the group consisting of a screen belt, nonwoven belt or conveyor belt, and wherein the mold is selected from the group consisting of a three-dimensional, single-piece or multi-piece mold with closed or perforated walls.

5. The method according to claim 3, wherein the high-viscosity suspension is filled into the mold under pressure.

6. The method according to claim 3, further comprising dewatering the high viscosity suspension by reduced pressure or via mechanical pressure, and wherein the drying is performed by thermal drying.

7. The method according to claim 1 wherein the drying is accomplished through use of a convective and/or conductive dryer and/or thermal radiation and/or electromagnetic radiation.

8. The method according to claim 1 wherein the drying is performed in a dryer in steps initially at temperatures ranging from 110° C. to 140° C., after which the temperature of the dryer is reduced to 70° C.

9. The method according to the claim 1 further comprising the step of adding additives to the suspension, wherein said additives are in the form of one or more of hydrophobizing agents, flame retardants, corona-shielding agents, and anti-mycotics.

10. The method according to claim 9 wherein the additives are used either alone or as mixtures of at least two additives in quantities of 0.2 mass % to 35 mass % based on a dry mass of the fibrous materials.

11. The method of claim 9 wherein hydrophobizing agents are selected from the group consisting of natural oils, paraffins, waxes, and organosilicon compounds, and the antimycotics comprise a mixture of soda and whey.

12. The method according to claim 1 further comprising adding to the suspension one or more organic foaming agents selected from the group consisting of azobisisobutyronitrile, activated azodicarbonamide, dinitropentamethylene tetramine, hydrazodicarbonamide, oxybissulfohydrazide, oxybisbenzenesulfohydrazide, 5-phenyltetrazole, paratoluenesulfonylsem icarbazide, toluene/benzenesulfohydrazide, and their salts.

13. The method of claim 12 wherein the salts are alkali metal salts or alkaline earth metal salts.

14. The method according to claim 12, wherein the organic foaming agents are used either alone or as mixtures of at least two organic foaming agents in proportions of 0.25% mass fractions up to 20% mass fractions based on a dry mass of the fibrous materials.

15. The method of claim 1 further comprising adding to the suspension one or more inorganic foaming agents selected from the group consisting of ammonium carbonate, sodium hydrogen carbonate, potassium hydrogen carbonate, disodium dihydrogen diphosphate, calcium dihydrogen phosphate, calcium citrate, and alse aluminum powder, alone or in an acidic or a basic medium.

16. The method according to claim 15, wherein the inorganic foaming agents are used either alone or as mixtures of at least two inorganic foaming agents in proportions of 0.25% mass fractions up to 20% mass fractions based on a dry mass of the fibrous materials.

17. The method according to claim 1 further comprising adding to the suspension one or more of spent sulfite, sulfate pulp liquor, turpentine oil, gelling agents, alginates, flour or starch from grain, potatoes, corn, peas or rice, and cross-linking agents.

18. The method according to claim 17 wherein the cross-linking agents are methyl cellulose or gluten.

19. The method according to claim 1 further comprising adding to the suspension one or more synthetic additives, and/or glutaraldehyde.

20. The method according to claim 19 wherein the synthetic additives regulate pH of the suspension and are selected from the group consisting of isocyanates, polymers, and alums.

21. The method according to claim 1 wherein the fibrous materials are acetylated prior to comminution or forming the aqueous fiber suspension.

22. The method according to claim 1 wherein the aqueous fiber suspension has between 5%-50% of fibers having a fiber length between 1000 μm and 2500 μm.

23. The method of claim 1 wherein the blowing agents are gas-producing agents or fully decomposing blowing agents.

24. The method of claim 19 wherein the blowing agents are selected from the group consisting of $N_2O$, propane, n-butane, pentane, or hydrogen peroxide.

* * * * *